US010490054B2

(12) United States Patent
Crawford et al.

(10) Patent No.: US 10,490,054 B2
(45) Date of Patent: Nov. 26, 2019

(54) IN-LINE INTEGRITY CHECKER

(71) Applicant: Halliburton Energy Services, Inc., Houston, TX (US)

(72) Inventors: Donald Leon Crawford, Spring, TX (US); Kristopher Lee Wilden, Cypress, TX (US); Tony Tran, Houston, TX (US); Charles Eugene Hamm, Spring, TX (US); Jose Maria Delgado, Cypress, TX (US); William George Dillon, Houston, TX (US); Jose German Vicente, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 283 days.

(21) Appl. No.: 15/039,396

(22) PCT Filed: Dec. 26, 2013

(86) PCT No.: PCT/US2013/077867

§ 371 (c)(1),
(2) Date: May 25, 2016

(87) PCT Pub. No.: WO2015/099742

PCT Pub. Date: Jul. 2, 2015

(65) Prior Publication Data

US 2017/0032653 A1 Feb. 2, 2017

(51) Int. Cl.
*E21B 43/1185* (2006.01)
*G08B 21/18* (2006.01)
(Continued)

(52) U.S. Cl.
CPC ..... *G08B 21/182* (2013.01); *E21B 43/119* (2013.01); *E21B 43/1185* (2013.01); *E21B 47/16* (2013.01)

(58) Field of Classification Search
CPC ..... E21B 43/11; E21B 43/114; E21B 43/116; E21B 43/117; E21B 43/119;
(Continued)

(56) References Cited

U.S. PATENT DOCUMENTS 3,860,865 A * 1/1975 Stroud ..... E21B 43/11857 102/217
4,454,814 A * 6/1984 Henry ..... F42D 1/05 102/200
(Continued)

FOREIGN PATENT DOCUMENTS

EP 0127340 12/1984
EP 0404669 12/1990
(Continued)

OTHER PUBLICATIONS

International Search Report and Written Opinion of PCT Application No. PCT/US2013/077867 dated Sep. 25, 2014: pp. 1-13.

*Primary Examiner* — David Carroll
(74) *Attorney, Agent, or Firm* — Chamberlain Hrdlicka

(57) ABSTRACT

Systems, methods and devices for an inline integrity checker are disclosed. The systems, methods and devices may include detection of impedance to a perforating gun disposed in a wellbore using a controller; a built-in impedance device; a shooting safety panel housing at least partially surrounding the built-in impedance device for restricting access to the built-in impedance device; one or more input devices for altering an impedance or resistance threshold level; and one or more alarms for indicating a condition exceeding the impedance or resistance threshold level as determined by the controller.

20 Claims, 5 Drawing Sheets

(51) Int. Cl.
*E21B 43/119* (2006.01)
*E21B 47/16* (2006.01)

(58) Field of Classification Search
CPC ..... E21B 43/1185; E21B 43/11857; E21B 47/16; E21B 49/04; G08B 21/18; G08B 21/182; G08B 21/185; G08B 21/187; F42D 1/05; F42B 3/121; F23Q 1/06
USPC ..... 361/247
See application file for complete search history.

(56) References Cited

U.S. PATENT DOCUMENTS

| | | | | |
|---|---|---|---|---|
| 4,640,354 | A | 2/1987 | Boisson | |
| 5,044,437 | A | 9/1991 | Wittrisch | |
| 5,159,145 | A | 10/1992 | Carisella et al. | |
| 6,053,111 | A | 4/2000 | Motley | |
| 6,152,246 | A * | 11/2000 | King | E21B 44/00 175/26 |
| 6,257,332 | B1 * | 7/2001 | Vidrine | E21B 43/12 166/250.15 |
| 7,387,156 | B2 | 6/2008 | Drummond et al. | |
| 8,161,880 | B2 | 4/2012 | Wuensche et al. | |
| 2007/0125530 | A1 * | 6/2007 | Lerche | E21B 41/00 166/55.1 |
| 2009/0168606 | A1 * | 7/2009 | Lerche | E21B 41/00 367/197 |
| 2010/0230105 | A1 * | 9/2010 | Vaynshteyn | E21B 43/11857 166/297 |
| 2011/0106452 | A1 | 5/2011 | Anderson et al. | |
| 2012/0227608 | A1 | 9/2012 | Givens et al. | |
| 2013/0031969 | A1 | 2/2013 | Brooks et al. | |
| 2015/0226057 | A1 * | 8/2015 | Bonavides | E21B 43/116 340/854.4 |

FOREIGN PATENT DOCUMENTS

| | | |
|---|---|---|
| EP | 1644688 | 4/2006 |
| WO | 01020127 | 3/2001 |
| WO | 02012676 | 2/2002 |

* cited by examiner

IN-LINE INTEGRITY CHECKER

FIELD

This invention relates, in general, to opening communication paths through a casing disposed in a wellbore and, in particular, to systems and methods for verifying the status of perforating guns prior to perforating the wellbore.

BACKGROUND

Without limiting the scope of the present invention, its background will be described in relation to perforating a wellbore, as an example.

After drilling the various sections of a subterranean wellbore that traverses a formation, individual lengths of relatively large diameter metal tubulars are typically secured together to form a casing string that is positioned within the wellbore. This casing string increases the integrity of the wellbore and provides a path for producing fluids from the producing intervals to the surface. Conventionally, the casing string is cemented within the wellbore. To produce fluids into the casing string, hydraulic openings or perforations must be made through the casing string, the cement and a distance into the formation.

Typically, these perforations are created by detonating a series of shaped charges that are disposed within the casing string and are positioned adjacent to the formation. Specifically, one or more charge carriers or perforating guns are loaded with shaped charges that are connected with a detonator via a detonating cord. The charge carriers are then connected within a tool string that is lowered into the cased wellbore at the end of a tubing string or other conveyance. Once the charge carriers are properly positioned in the wellbore such that the shaped charges are adjacent to the formation to be perforated, the shaped charges may be fired. If more than one downhole zone is to be perforated, a select fire perforating gun assembly may be used such that once the first zone is perforated, subsequent zones may be perforated by repositioning and firing the previously unfired perforating guns without tripping out of the well.

Typically, oil well perforating operations involve a thorough check of the perforating gun system or gun string. The operator must ensure the system is electrically robust as well as safe. A typical perforating operation involves a "check fire test" where the operator verifies the surface system as well as the downhole equipment, usually involving a casing collar locator and a cable head. The purpose of this check is to verify that there are no insulation leaks as well as to verify the electrical continuity of the whole system. There are no explosives involved in the check process.

Subsequently, the oil well perforating operations may connect the one or more explosive devices to the already checked casing collar locator plus cable head. The explosive device may then be armed. At this point, all electrical sources are shut down and the logging cable is shorted at the surface. The procedure requires that all the electrical sources can be restored when the device is below 200 ft. from ground level. No further test on the explosive device electrical continuity, however, can be performed on an armed device. A regular blast meter could be used after the explosive device is below 200 ft., but such operation is not allowed as it requires the operator to manually access the wireline circuit at the surface with the associated risk of making a bad connection or using the wrong type of meter, which could risk unintentional explosion initiation out of the intended depth.

BRIEF DESCRIPTION OF THE DRAWINGS

The accompanying drawings, which are included to provide a further understanding of the disclosure and are incorporated in and constitute a part of this specification, illustrate preferred embodiments of the disclosure and together with the detailed description serve to explain the principles of the disclosure. In the drawings.

DETAILED DESCRIPTION OF ILLUSTRATIVE EMBODIMENTS

In the following detailed description of the illustrative embodiments, reference is made to the accompanying drawings that form a part hereof. These embodiments are described in sufficient detail to enable those skilled in the art to practice the described systems and methods, and it is understood that other embodiments may be utilized and that logical structural, mechanical, electrical, and chemical changes may be made without departing from the spirit or scope of the described systems and methods. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

While the making and using of various embodiments described herein are discussed in detail below, it should be appreciated that the described systems and methods provide many applicable inventive concepts which can be embodied in a wide variety of specific contexts. The specific embodiments discussed herein are merely illustrative of specific ways to make and use the invention, and do not delimit the scope of the invention.

Figure 1:
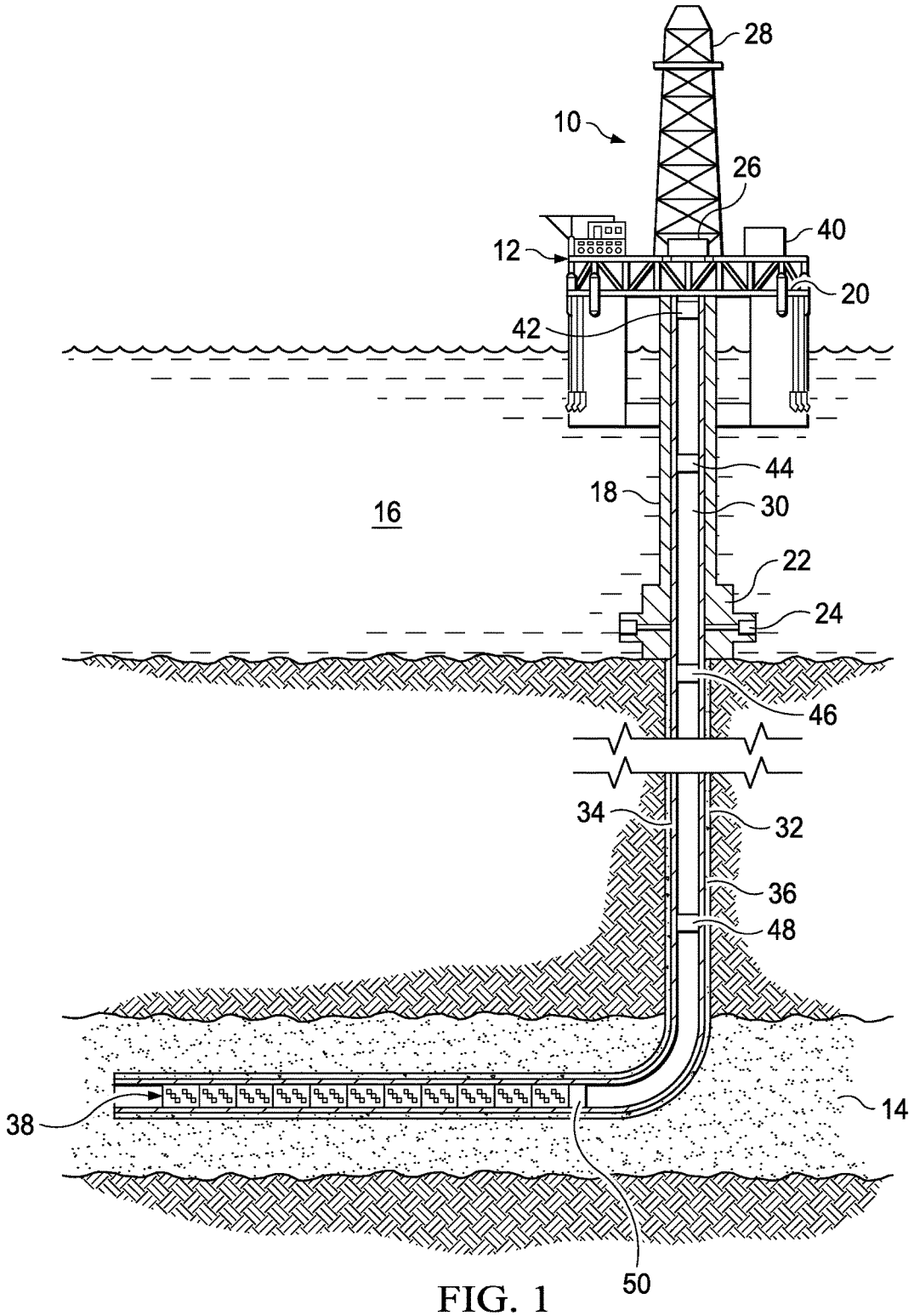
FIG. 1 is a schematic illustration of an offshore oil and gas platform operating a system for verifying the status of perforating guns prior to perforating a wellbore according to one embodiment.

Referring initially to FIG. 1, a system for verifying the status of perforating guns prior to perforating a wellbore is operating from an offshore oil and gas platform that is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including subsea blow-out preventers 24. Platform 12 has a hoisting apparatus 26 and a derrick 28 for raising and lowering pipe strings such as work sting 30.

A wellbore 32 extends through the various earth strata including formation 14. A casing 34 is cemented within wellbore 32 by cement 36. Work string 30 includes various tools such as a plurality of perforating guns 38 disposed in a generally horizontal portion of wellbore 32 and a communication system including communication nodes 42, 44, 46, 48, 50. In the illustrated embodiment, a surface communication node or controller 40 provides a user interface including, for example, input and output devices such as one or more video screens or monitors, including touch screens, one or more keyboards or keypads, one or more pointing or navigation devices, as well as any other user interface devices that are currently known to those skilled in the art or are developed. The user interface may take the form of a computer including a notebook computer. In addition, surface controller 40 may include a logic module having various controllers, processors, memory components, operating systems, instructions, communication protocols and the like for implementing the systems and methods for verifying the status of perforating guns. Surface controller 40 is coupled to a bidirectional communication link that provides for communication between surface controller 40 and a node 42 that is positioned in the well as part of or attached to work string 30.

The bidirectional communication link may include at least one communication path from surface controller 40 to node 42 and at least one communication path from node 42 to surface controller 40. In certain embodiments, bidirectional communication may be achieved via a half-duplex channel which allows only one communication path to be open in any time period. Preferably, bidirectional communication is achieved via a full duplex channel which allows simultaneous communication over multiple communication paths. This can be achieved, for example, by providing independent hardwire connections or over a shared physical media through frequency division duplexing, time division duplexing, echo cancellation or similar technique. In either case, the communication link may include one or more electrical conductors, optical conductors or other physical conductors.

Each of communication nodes 42, 44, 46, 48, 50 may include a transmitter, a receiver and a logic module that includes, for example, various fixed logic circuits, controllers, processors, memory components, operating systems, instructions, communication protocols and the like for implementing the systems and methods for verifying the status of perforating guns of the present invention. In addition, each communication node 42, 44, 46, 48, 50 may also include a power supply such as a battery pack which may include a plurality of batteries, such as nickel cadmium, lithium, alkaline or other suitable power source, which are configured to provide proper operating voltage and current.

In one embodiment, communication nodes 42, 44, 46, 48, 50 may be operable to transmit and receive impedance or other signals, such as acoustic signals, that are propagated over work string 30. In this case, the transmitters and receivers of communication nodes 42, 44, 46, 48, 50 preferably include one or more transducers in various forms, such as in the form of stacks of piezoelectric ceramic crystals. It should be noted that a single transducer may operate as both the transmitter and the receiver of a given communication node. Any number of communication nodes may be operated in the system of the present invention with the number determined by the length of work string 30, the noise in the wellbore, the type of communication media used and the like. As illustrated, communication nodes 44, 46, 48 serve as repeaters that are positioned to receive the acoustic signals transmitted along work string 30 at a point where the signals are of a magnitude sufficient for adequate reception. Once the signals reach a given node, if necessary, the signals may be converted to an electrical current which represents the information being transmitted and is fed to the logic module for processing. In certain embodiments, the current may then be sent to the transducer to generate acoustic signals that are transmitted to the next node. In this manner, communication from node 40 to node 50 as well as from node 50 to node 40 may be achieved.

When it is desired to perforate casing 34, work string 30 may be lowered through casing 34 until the perforating guns 38 are properly positioned relative to formation 14. To verify the condition of perforating guns 38 prior to the perforating operation, an interrogation command may be sent from surface controller 40 to sensors disposed in perforating guns 38. For example, each perforating gun 38 may include one or more sensors such as moisture sensors, pressure sensors, leak sensors, etc. Preferably, each of these sensors is individually addressable and communicates with communication node 50 via a wired connection but a short range wireless connection such as an electromagnetic communication link could alternatively be used.

Accordingly, when surface controller 40 sends interrogation commands to determine the status of perforating guns 38 to one or more of the sensors, the commands may be received by communication node 42 and retransmitted as encoded signals along work string 30, which are received by communication node 44. Communication node 44 may act as a repeater to receive, process and retransmit the commands via signals along work string 30 which are received by communication node 46. Likewise, communication node 46 may forward the commands to communication node 48 via signals along work string 30 and communication node 48 forwards the commands to communication node 50 via signals along work string 30. Communication node 50 may then send the commands to interrogate each of the sensors in perforating guns 38. The sensors may obtain the desired data regarding the leak status of each perforating gun 38 and provide this information to communication node 50. Communication node 50 may convert this information to signals that are sent to communication node 48 along work string 30. Communication nodes 48, 46, 44 may act as repeaters, each receiving, processing and retransmitting the information in the form of signals along work string 30. Communication node 42 may receive the signals sent from communication node 44 and processes the information such that it can be forwarded to surface controller 40 for analysis.

If the sensors report that no leaks or other issues have been identified within perforating guns 38, then the communication system may be used in a similar manner to enable, arm and fire perforating guns 38 using, for example, one or more electronic or hydraulic firing heads. Thereafter, the shaped charges within perforating guns 38 may be sequentially fired, either in an uphole to downhole or a downhole to uphole direction, or in any other order. Upon detonation, the liners of the shaped charges may form jets that create a spaced series of perforations extending outwardly through casing 34, cement 36 and into formation 14, thereby allow fluid communication between formation 14 and wellbore 32.

In the illustrated embodiment, wellbore 32 may have an initial, generally vertical portion and a lower, generally deviated portion which is illustrated as being horizontal. It should be noted, however, by those skilled in the art that the system for verifying the status of perforating guns of the present invention is equally well-suited for use in other well configurations including, but not limited to, inclined wells, wells with restrictions, non-deviated wells and the like.

In addition, even though FIG. 1 has been described with reference to an offshore environment, it should be understood by one skilled in the art that the principles described herein are equally well-suited for an onshore environment.

As should be understood by those skilled in the art, any of the functions described with reference to a logic module herein can be implemented using software, hardware, including fixed logic circuitry, manual processing or a combination of these implementations. As such, the term "logic module" as used herein generally represents software, hardware or a combination of software and hardware. For example, in the case of a software implementation, the term "logic module" represents program code and/or declarative content, e.g., markup language content, which performs specified tasks when executed on a processing device or devices such as one or more processors or CPUs. The program code can be stored in one or more computer readable memory devices. More generally, the functionality of the logic modules may be implemented as distinct units in separate physical grouping or can correspond to a conceptual allocation of different tasks performed by a single software program and/or hardware unit. The logic modules can be located at a single site such as implemented by a single processing device, or can be distributed over plural locations such as a notebook computer, personal digital assistant, smartphone, tablet, etc. in combination with other physical devices that communication with one another via wired or wireless connections.

Figure 2:
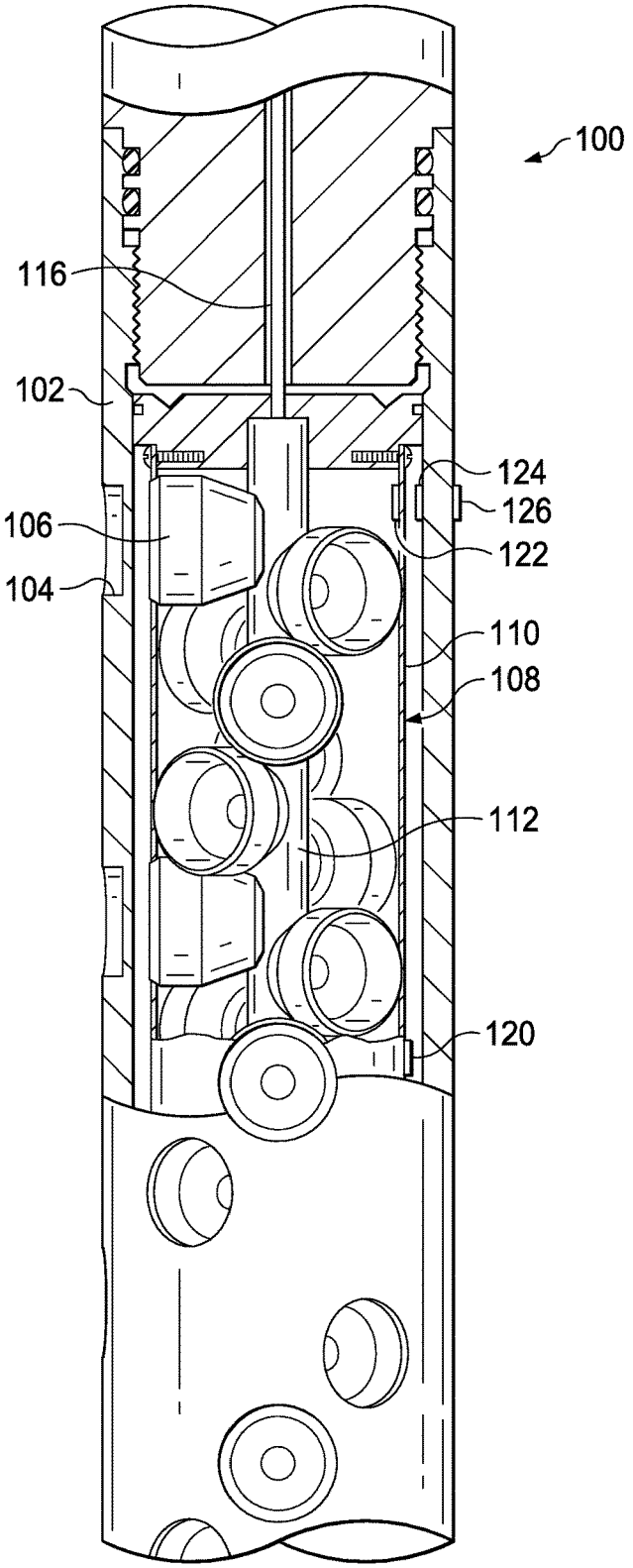
FIG. 2 is a partial cut away view of a perforating gun for use in a system for verifying the status of perforating guns prior to perforating a wellbore according to one embodiment.

Referring next to FIG. 2, therein is depicted a perforating gun for use in the system for verifying the status of perforating guns of the present invention that is generally designated 100. Perforating gun 100 may have a carrier 102 having a plurality of recesses, such as recess 104, defined therein. Radially aligned with each of the recesses is a respective one of the plurality of shaped charges, such as shaped charge 106.

The shaped charges may be retained within carrier 102 by a support member 108 which may include an outer charge holder sleeve 110 and an inner charge holder sleeve 112. In this configuration, outer tube 110 may support the discharge ends of the shaped charges, while inner tube 112 supports the initiation ends of the shaped charges. Disposed within inner tube 112 may be a detonating cord 116. In the illustrated embodiment, the initiation ends of the shaped charges may extend across the central longitudinal axis of perforating gun 100 allowing detonating cord 116 to connect to the high explosive within the shaped charges through an aperture defined at the apex of the housings of the shaped charges. In this configuration, carrier 102 may be sealed to protect the shaped charges disposed therein against wellbore fluids.

Each of the shaped charges, such as shaped charge 106, may be longitudinally and radially aligned with a recess, such as recess 104, in carrier 102 when perforating apparatus 100 is fully assembled. In the illustrated embodiment, the shaped charges may be arranged in a spiral pattern such that each shaped charge is disposed on its own level or height and is to be individually detonated so that only one shaped charge is fired at a time. It should be noted, however, by those skilled in the art that alternate arrangements of shaped charges may be used, including cluster type designs wherein more than one shaped charge is at the same level and is detonated at the same time, without departing from the principles of the present invention.

As discussed above, perforating guns for use in the system for verifying the status of perforating guns of the present invention, such as perforating gun 100, may include one or more sensors used to obtain and provide information relative to environmental factors that surround perforating gun 100. In the illustrated embodiment, perforating gun 100 includes a plurality of sensors such as sensor 120 positioned on the exterior of support member 108, sensor 122 positioned on the interior of support member 108, sensor 124 positioned on the interior of carrier 102 and sensor 126 positioned on the exterior of carrier 102. As discussed above, sensors 120, 122, 124, 126 may be preferably coupled to communication node 50 via a wired connection but other communication means are also possible and considered within the scope of the present invention.

Sensors 120, 122, 124, 126 may be of the same type or different types and may be moisture sensors, humidity sensors, pressure sensors including high speed pressure sensors or fast gauge sensors, temperature sensors, accelerometers, shock load sensors, liner displacement sensors, depth sensors, fluid sensors, $CO_2$ sensors, $H_2S$ sensors, CO sensors, thermal decomposition sensors, casing collar locators, gamma detectors or any other types of sensors that are operable to provide information relating to the perforating gun environment. Sensors 120, 122, 124, 126 and similar sensors associated with the perforating gun system may be used for monitoring a variety of environmental conditions relative to the gun string such as the depth and orientation of the guns in the wellbore; the condition of the guns prior to firing including leak status, pressure, thermal decomposition and moisture; whether the guns fired properly including gun pressures, accelerations and shock loads; the near wellbore reservoir parameters including temperatures, hydrostatic pressures, peak pressures and transient pressures as well as other environmental conditions that are known to those skilled in the art.

Embodiments described herein may provide for a wireline and explosive device conductivity measurement in a proven safe and automated manner. This information may be important for an operator to avoid a miss-run and reduce lost time in case of a failure.

Embodiments may include a built-in device, such as an impedance detection meter, located at least partially within or securely coupled to a shooting safety panel. Preferably, the built-in device is secured to prevent external or manual access. The location of the built-in device may prevent any type of external or manual access to the wireline circuit with the associated risk associated with manual intervention.

The built-in device may inject a safe and low level electrical current and measure the resulting voltage, such that the resulting impedance can be calculated. The calculated impedance may be displayed to a user, such as on the shooting panel or through other means, such as wireless or wired communication to a separate computing device.

The built-in device may be calibrated to recognize the different type of detonators used to compensate the measurement and impedance calculation. The built-in device may also include internal rechargeable batteries or another power source so that it can operate even if the surface system is shut down. This may improve safety of the device as the battery low voltage may be current limited and at the same time the charging current may be current limited via physical resistance preventing higher voltage from reaching the wireline circuit even in the event of a power surge or power circuit failure or panel fire.

The built-in device may produce the measurement on demand or remain in continuous monitoring mode so the user can have an impedance reading all the way while downing the explosive device until it is placed in depth for shooting.

Figure 3:
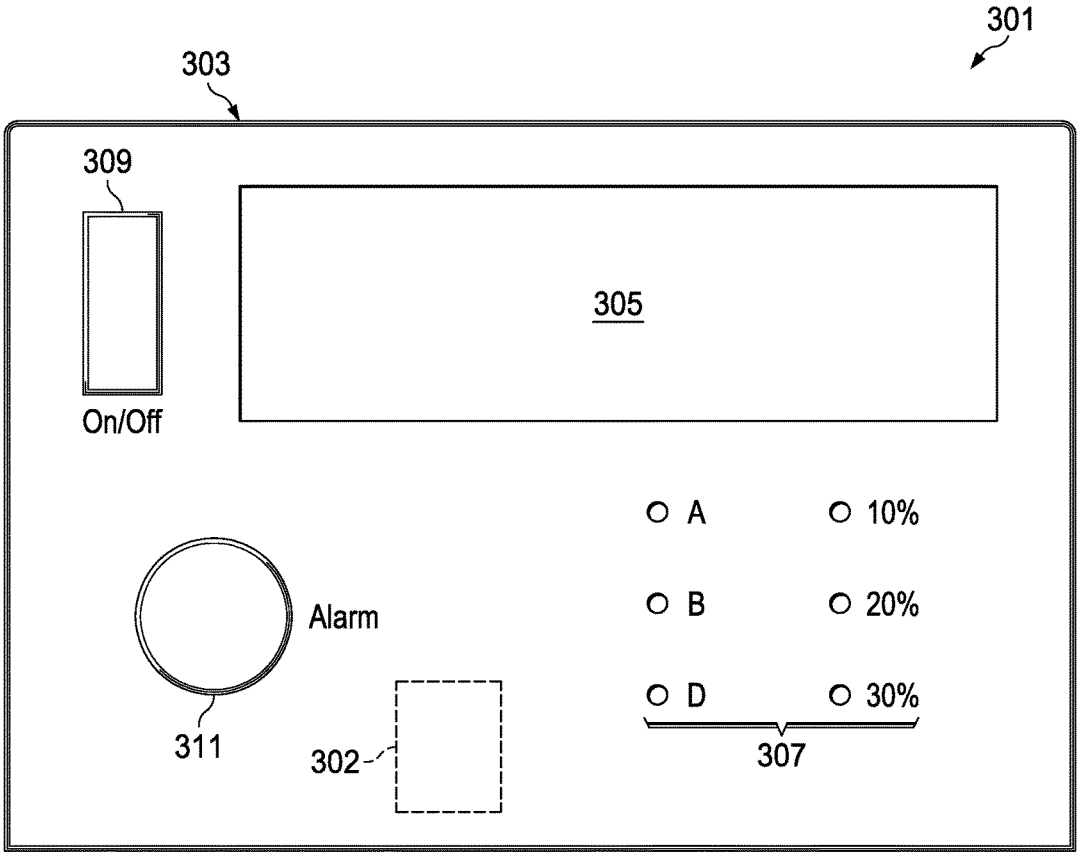
FIG. 3 illustrates an exemplary shooting safety panel with built-in impedance display according to one embodiment.

FIG. 3 illustrates an exemplary shooting safety panel 301 with built-in device 302, such as an impedance detector, according to one embodiment. The panel 301 may include a housing 303 or other structural component. The housing 303 may be closed, sealed, etc. to prevent manual access to interior components, such as the built-in device 302. The housing 303 may include one or more spaces for inputs, displays, switches, etc. For example, a display 305 may be included in the panel 301. The display 305 may be any type of display, such as an LCD display. The display 305 may indicate one or more parameters of the system operation. Display characteristics may include readouts, measurements, notifications, etc. The display 305 may provide information regarding active quality control and/or quality assurance regarding the quality and stability of the wireline, surface, and downhole gear in a passive mode. The display 305 may provide an absolute reading of system impedance. Alternatively, one or more touch panel screens may be used to input and/or display information. One or more inputs 307 may be included on the panel 301. For example, thresholds may be selected and displayed on the panel 301. In certain embodiments, threshold mode may be selected and/or displayed such as A (above), B (below), D (above and below). Threshold scalar may be selected and/or displayed as 10%, 20%, 30%, or any other values. Indicator lights may show the current selection. Readings may be displayed on the panel 301 and may include indications of status of device ("Arm", "Off", "Ready to Trigger", etc.), location of tool ("CCL", etc.), logging status ("log", etc.). Information and display may be integrated into a panel, such as a WSP1 panel. One or more switches 309 may be included to operate various aspects of the system, including a master on/off switch, on/off switches for various components or operations, etc. An auto zero option may be included to set aside cables reading on the surface. One or more indicators 311 may be included on the panel 301 to alert a user to a set condition, such as if the threshold is met per the selected mode and scalar. The one or more indicators may be lights, audio cues, etc.

Figure 4:
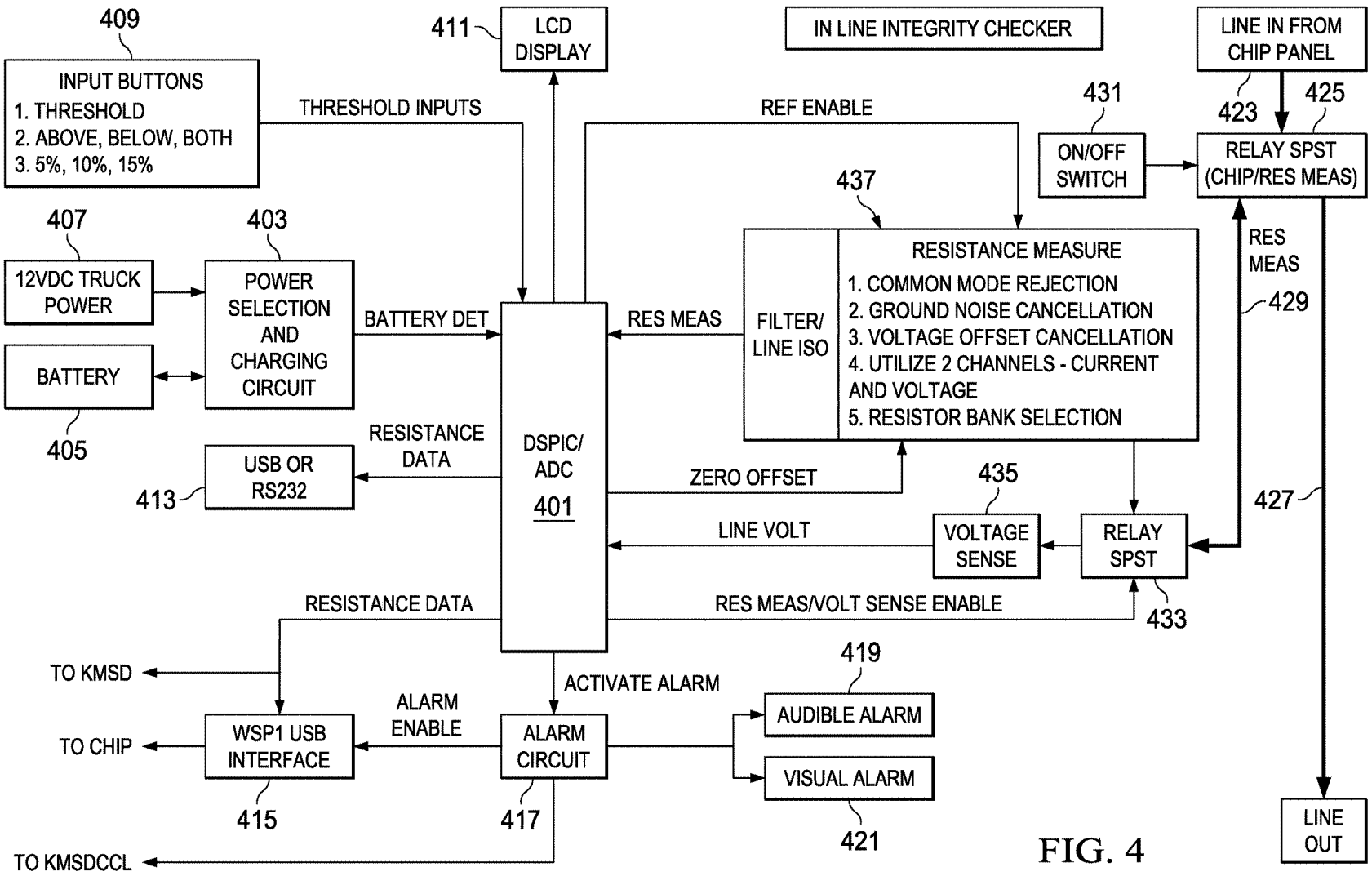
FIG. 4 is a schematic illustration of an in-line integrity checker according to one embodiment.

FIG. 4 is a schematic illustration of an in-line integrity checker according to one embodiment. One or more components may be located within a shooting safety panel. An analog to digital converter (ADC) may convert one or more incoming signals to a centralized location, such as a processor or controller 401. Although a DsPIC digital signal controller is shown, any similar device may be used. The controller 401 may receive input regarding power from a power selection and/or charging circuit 403. The power selection and/or charging circuit 403 may receive information and/or power from a battery 405 and/or an alternative power source 407, such as a truck power source. In certain embodiments, the truck power source is a 12 V DC power supply. Threshold inputs may be received from one or more inputs 409, such as input buttons for threshold modes and/or scalars (see FIG. 3). The controller 401 may output information to a display 411. The control 401 may also provide resistance data to another device, such as an external device, via a connection 413, such as a USB connection or RS232 connection. Other connections may be used. Resistance data may also be sent to other devices, such as a KMSD, a chip, via an interface, such as a WSP1 or USB interface, or other devices. Various interfaces may be used.

If necessary, an alarm may be required. An alarm circuit 417 may receive data from the controller 401. The alarm circuit 417 may activate one or more of an audible alarm 419 and/or a visual alarm 421. Alarm information, such as enablement may be sent to a chip and/or a tool locator, such as a KMSD CCL.

On a wireline side of the device, a line in 423 may come from a chip panel. A relay switch 425, such as a single pull, single throw (SPST) switch, may be used. The relay switch 425 may provide a connection to a line out 427 and/or a resistance measurement 429. An on/off switch 431 may control the relay switch 425. The resistance measurement 429 may be received at a relay switch 433, such as an SPST switch. The relay switch 433 may provide data to a voltage sensor 435, which then provides line voltage to the controller 401. The voltage sensor 435 may determine if there is any stray voltage via a voltage threshold detection.

A filter/line ISO 437 may receive information regarding a resistance measurement, such as a zero offset and/or a REF enable. The resistance measurement may utilize a voltage and current measurement technique that is immune to widely varying ground noise of, for example, a truck body and wireline cable. The voltage and current measurement technique may also be immune to the variations in power supply rails. The measurement technique may combine various stages such as isolation, common mode rejection, ground noise cancelation, DC voltage offset cancelation, resistance bank selection, and filtering. In certain embodiments, the resistance measurement may include line isolation up to, for example, a kilovolt, protecting the electronics from voltage surges in the line. The isolation circuitry may ensure that unwanted or extra noise in the isolation process is removed. The measured signals may then be subject to common mode rejection to eliminate any DC offset in the common voltage line, at least partially contributing to improving the accuracy of the measurement. In certain embodiments, two parallel measurements may be taken simultaneously to achieve measurement accuracy and to reduce any discrepancy due to drift in time in the measured signals. This may remove any extra additional DC offset and may make the system more immune to ground noise and power rail ripples. At this stage, timing in measurement relative to changes in signals being measured may be critical and may improve measurement accuracy. The accuracy may be further improved by using various resistor banks to make sure the measurement stays within a good accuracy regions imposed by hardware and firmware, especially during analog to digital conversion as well as during analog processing such as filtering. Finally, the measured signals may be filtered by analog filters to obtain clean signals for analog converters to meet ADC quantization error requirements. This filter may include, but is not limited to, any induced interference such as those from the truck, for example, an approximately 50 Hz power supply. The measurement analog signals may then be returned from the filter/line ISO 437 to the controller 401 where they are digitized, processed and calculated into one or more line resistance values. This process may be controlled and timed by the controller. As indicated, the resistance measurement may include information regarding common mode rejection, ground noise cancellation, voltage offset cancellation, utilization of two or more channels, such as current and voltage, and resistor bank selection. A resistance measurement may be returned from the filter/line ISO 437.

The relay switch 433 may also receive an output from the filter/line ISO 437 and a resistance measurement/voltage sensor enablement indication from the controller 401.

Figure 5:
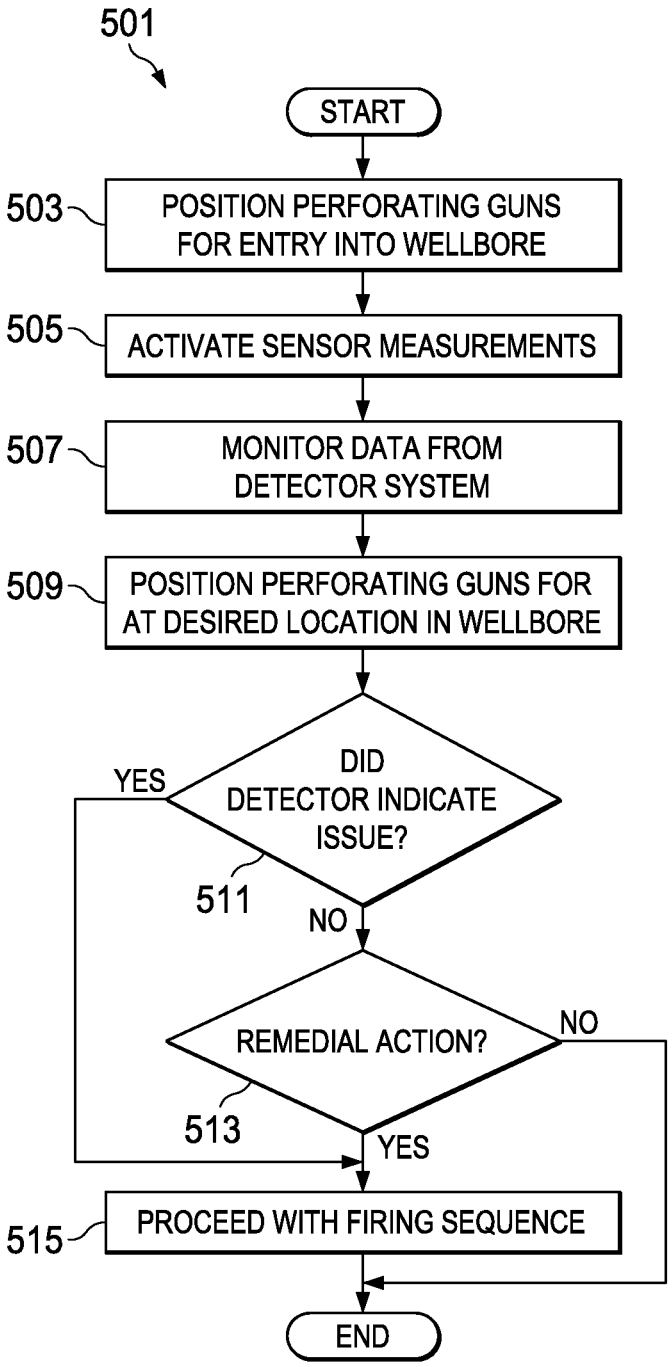
FIG. 5 is a flow chart illustrating a method for verifying the status of perforating guns prior to perforating a wellbore according to one embodiment.

The operation of one embodiment will now be described as process 501 with reference to FIG. 5. One or more perforating guns may be prepared to enter into a wellbore (step 503). The shooting safety panel with built-in device may be activated, such as by a switch, even if power to the explosive device is off (step 505). Sensor measurement may be taken at user-selected times, at predetermined times, and/or continuously (step 507). The perforating guns may be positioned at the target location in the wellbore (step 509).

Prior to detonating the shaped charges, the system of the present invention may be operable to perform a variety of gun condition verifications such as those described above and including perforating gun depth and orientation verification and perforating guns condition verification. This verification may be accomplished using the surface controller in conjunction with communication nodes positioned along the work string to interrogate sensors associated with the perforating guns for the desired information.

Once all of the sensors have been interrogated, the surface controller may determine whether the perforating guns are ready for firing (step 511). If the perforating guns are ready, the surface controller may proceed with the remainder of the firing sequence including sending the appropriate enable, arm and fire commands via the communication nodes to a suitable firing head (step 515). If all of the perforating guns are not ready, the surface controller may determine whether remedial action can be taken to allow the perforating event to occur (step 513). Such remedial action may include repeating the verification process to determine if an out of range condition persists, identifying which guns have an out of range condition and removing those guns from the firing sequence or the like. If in performing such remedial action the surface controller determines that the perforating event should occur, then the surface controller may proceed with the remainder of the firing sequence (step 513). If in performing such remedial action it is determined that the perforating event may not occur, then the process may end.

During the perforating event, sensors associated with the perforating guns may continue gather and transmit information. Specifically, sensors such as accelerometers, pressure sensors, high speed pressure sensors, temperature sensors and the like are used to obtain a variety of perforating gun and near wellbore reservoir data. For example, the high speed pressure sensors are operably to obtain pressure data in the millisecond range such that the pressure surge and associated pressure cycles created by the perforating event can be measured. Likewise, the accelerometers are operable to record shock data associated with the perforating event. Use of this and other data provide for a determination of the intensity level of the detonation associated with the perforating guns. During, immediately after or at a later time, this information is communicated from the sensors to the surface controller over the communication system. This information may be used to determine the quality of the perforating event such as whether the initiator was detonated, whether any of the shaped charges within the perforating gun were detonated, whether all of the shaped charges within the perforating gun were detonated or whether only some of the shaped charges within the perforating gun were detonated. This information will allow the operator in substantially real time to determine, for example, if a zone should be reperforated.

Likewise, following the perforating event, the sensors associated with the perforating guns may continue gather and transmit information. Specifically, sensors such as the pressure sensors, temperature sensors, fluid sensors and the like are used to obtain a variety of near wellbore reservoir data. This data may be useful in designing the next phase of the completion such as whether to perform an acid job or a fracture stimulation.

Embodiments described herein may reduce time spent run in hole with a bad assembly. The systems and methods may allow for visibility of changes in the system on the way into a hole, and when there may be equipment changes in mode such as electrical disconnect on CSR. Certain embodiments may provide the ability to troubleshoot downhole assemblies before retrieval to the surface. A constant reading of power down impedance may be provided for the deployment system.

It should be apparent from the foregoing that an invention having significant advantages has been provided. While the invention is shown in only a few of its forms, it is not limited to only these embodiments but is susceptible to various changes and modifications without departing from the spirit thereof.

The invention claimed is:

1. A system for detecting impedance to a perforating gun disposable in a wellbore, the system comprising:

a controller located at the surface;

a shooting safety panel located at the surface and at least partially surrounding to restrict manual access externally from the shooting safety panel to a built-in impedance device operable to calculate impedance to the perforating gun by injecting a safe electrical current and measuring a resulting voltage;

one or more input devices for altering an impedance or resistance threshold level; and one or more alarms for indicating a condition exceeding the impedance or resistance threshold level as determined by the controller.

2. The system of claim 1, further comprising one or more display devices for displaying an impedance or resistance condition.

3. The system of claim 1, further comprising a relay switch for turning on or off a resistance measurement.

4. The system of claim 1, further comprising outputting resistance data through one or more interfaces.

5. The system of claim 1, further comprising outputting an alarm through one or more interfaces.

6. The system of claim 1, wherein the one or more alarms are audible alarms or visible alarms.

7. The system of claim 1, further comprising one or more voltage sensors.

8. The system of claim 1, wherein the one or more voltage sensors are operated by one or more switches.

9. A system for detecting impedance to a perforating gun disposable in a wellbore, the system comprising:

one or more perforating guns disposable in the wellbore;

a controller located at the surface;

a communication system for communicating between the one or more perforating guns and the controller;

a shooting safety panel located at the surface and at least partially surrounding to restrict manual access externally from the shooting safety panel to a built-in impedance device operable to calculate impedance to the perforating gun by injecting a safe electrical current and measuring a resulting voltage;

one or more input devices for altering an impedance or resistance threshold level; and one or more alarms for indicating a condition exceeding the impedance or resistance threshold level as determined by the controller.

10. The system of claim 9, further comprising one or more display devices for displaying an impedance or resistance condition.

11. The system of claim 9, further comprising a relay switch for turning on or off a resistance measurement.

12. The system of claim 9, further comprising outputting resistance data through one or more interfaces.

13. The system of claim 9, further comprising outputting an alarm through one or more interfaces.

14. The system of claim 9, wherein the one or more alarms are audible alarms or visible alarms.

15. The system of claim 9, further comprising one or more voltage sensors.

16. The system of claim 9, wherein the one or more voltage sensors are operated by one or more switches.

17. A method for detecting impedance to a perforating gun in a wellbore, the method comprising:

coupling a perforating gun to a shooting safety panel at the surface via a communication system;

activating a built-in impedance detection device located at least partially within the shooting safety panel to restrict manual access to the impedance detection device externally from the shooting safety panel;

running the perforating gun to a target location within the wellbore on a tubing string while the built-in impedance detection device is active;

injecting a safe electrical current;

measuring a resulting voltage;

calculating a resulting impedance to the perforating gun;

determining whether the resulting impedance exceeds a predetermined threshold; and determining whether to operate the perforating gun based upon the resulting impedance and predetermined threshold determination.

18. The method of claim 17, further comprising continuously monitoring resistance during running the perforating gun to a target location within the wellbore.

19. The method of claim 17, wherein the predetermined thresholds are selected by a user via one or more inputs on the shooting safety panel.

20. The method of claim 17, further comprising activating an alarm if measurements exceed the predetermined threshold.

* * * * *